US007928320B2

(12) United States Patent
Nevett et al.

(10) Patent No.: US 7,928,320 B2
(45) Date of Patent: Apr. 19, 2011

(54) HELICALLY-WOUND ELECTRIC CABLE

(75) Inventors: Jonathan Nevett, Buizingen (BE); Thomas Haehner, Fumay (FR)

(73) Assignee: Nexans (FR)

( * ) Notice: Subject to any disclaimer, the term of this patent is extended or adjusted under 35 U.S.C. 154(b) by 163 days.

(21) Appl. No.: 12/464,903

(22) Filed: May 13, 2009

(65) Prior Publication Data

US 2010/0116522 A1 May 13, 2010

(30) Foreign Application Priority Data

Jun. 2, 2008 (EP) ..... 08305222

(51) Int. Cl.
*H01B 11/02* (2006.01)

(52) U.S. Cl. ..... 174/27; 174/110 R; 174/113 R

(58) Field of Classification Search ..... 174/27, 174/28, 36, 110 R, 113 R; 57/59, 58.82–58.86
See application file for complete search history.

(56) References Cited

U.S. PATENT DOCUMENTS

| | | | | |
|---|---|---|---|---|
| 5,739,473 | A * | 4/1998 | Zerbs | 174/121 A |
| 5,767,441 | A * | 6/1998 | Brorein et al. | 174/27 |
| 6,211,467 | B1 * | 4/2001 | Berelsman et al. | 174/113 R |
| 7,497,070 | B2 * | 3/2009 | Nevett | 57/59 |
| 7,663,058 | B2 * | 2/2010 | Nevett | 174/27 |
| 2005/0092515 | A1 * | 5/2005 | Kenny et al. | 174/113 R |
| 2006/0059883 | A1 * | 3/2006 | Hopkinson et al. | 57/236 |

* cited by examiner

*Primary Examiner* — William H Mayo, III
(74) *Attorney, Agent, or Firm* — Sofer & Haroun, LLP

(57) ABSTRACT

A helically-wound electric cable having at least two groups wound together so as to form a group helix. Each group has at least two twisted-together conductor wires, wherein the pitch of the group helix varying along the helically-wound electric cable in accordance with a sinusoidal function between two limit values having the same sign, characterized in that said sinusoidal function has a determined modulation period (MP) in order to avoid return loss peak (RLp) in the operating frequency range (Fmin-Fmax) of said helically-wound electric cable.

5 Claims, 3 Drawing Sheets

HELICALLY-WOUND ELECTRIC CABLE

RELATED APPLICATION

Background

1. Field of the Invention

The present invention relates to the field of helically-wound electric cables.

2. Discussion of Related Art

An electric cable comprises one or more groups of twisted conductor wires. A group is conventionally constituted by two twisted-together conductor wires, in which case it is called a "pair". But it could equally well comprise more than two twisted-together conductor wires.

A helically-wound electric cable comprises a plurality of groups that are wound together to form a helix.

The document EP 1 688 968 provides a helically-wound electric cable comprising at least two groups wound together so as to form a group helix, each group comprising at least two twisted-together conductor wires. According to this document, the pitch (or lay) of the group helix varies along the helically-wound electric cable according to a sinusoidal function between two limit values having the same sign.

The variations in the pitch of the group helix serve to minimize parallelism between the conductor wires, thereby reducing the near end cross-talk peaks or NEXT peaks.

However, it was found that there could occur peaks in the return loss of the pairs at frequencies related to the pitch of the group helix with the implication that the periodic mechanical disturbance of the pairs during the formation of the group helix was sufficient to cause a small but significant periodic variation in their impedances along the length of the cable.

OBJECTS AND SUMMARY

The present invention seeks to solve the above-mentioned problems of the prior art.

To this end, an object of the present invention is to provide a helically-wound electric cable comprising at least two groups wound together so as to form a group helix, each group comprising at least two twisted-together conductor wires, the pitch of the group helix varying along the helically-wound electric cable in accordance with a sinusoidal function between two limit values having the same sign, characterized in that said sinusoidal function has a determined modulation period (MP) in order to avoid return loss peak (RLp) in the operating frequency range ($F_{mm}$-$F_{max}$) of said helically-wound electric cable.

In a specific embodiment, the modulation period (MP) is below a lower limit LL, in meter, of the following formula:

$$LL=v_{min}\cdot 150/F_{max} \quad \text{(I)}$$

in which $F_{max}$, in MHz, is the maximum operating frequency of the helically wound electric cable and $v_{min}$ is the smallest velocity factor required for a determined cable application at the maximum operating frequency $F_{max}$.

In another specific embodiment, the modulation period (MP) is above an upper limit UL, in meter, of the following formula:

$$UL=v_{max}\cdot 150/F_{min} \quad \text{(II)}$$

in which $F_{mm}$, in MHz, is the maximum operating frequency of the helically wound electric cable and $v_{max}$ is the highest velocity factor required for a determined cable application at the minimum operating frequency $F_{min}$.

The twisted conductor wires of the helically-wound electric cable of the present invention can directly abut one another.

Furthermore, the helically-wound electric cable can comprise at least one additional group helix.

BRIEF DESCRIPTION OF THE DRAWINGS

The present invention will become more fully understood from the detailed description given hereinbelow and the accompanying drawings which are given by way of illustration only, and thus, are not limits of the present invention, and wherein.

DETAILED DESCRIPTION

Figure 1:
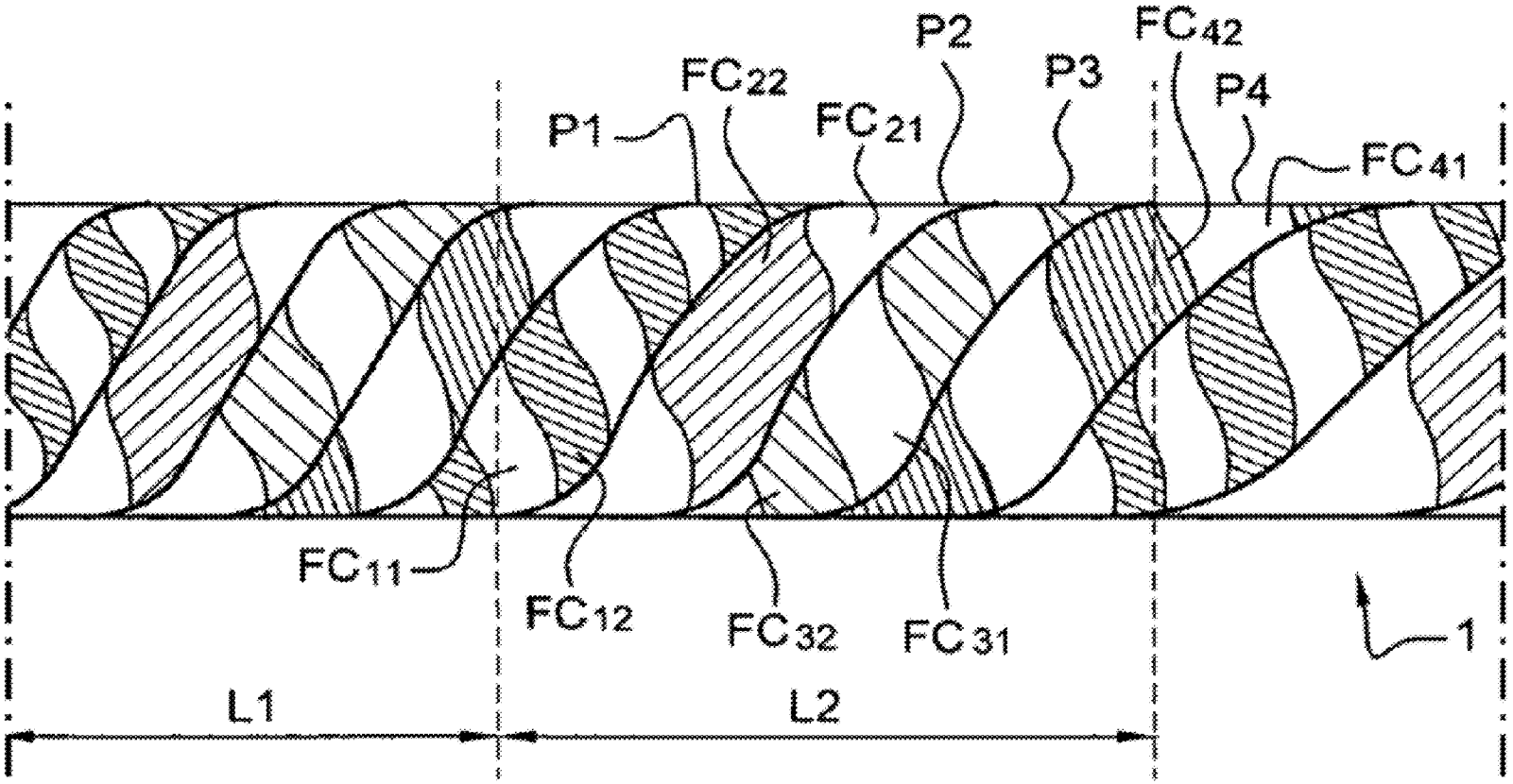
FIG. 1 shows an example of a helically-wound electric cable according to the present invention.

According to cabling standard ISO 11801 which specifies the cabling system of cables and connectors and the appended cable standard IEC 61156, the different characteristics of category 5e, 6, 6A, 7, 7A helically-wound electric cables are mentioned in the Table 1 as below.

TABLE 1

| Variable | | Unit | 1 Cat 5e U/UTP | 2 Cat 5e U/UTP | 3 Cat 6 U/UTP | 4 Cat 6A F/UTP | 5 Cat 7 600 S/FTP | 6 Cat 7A 1000 S/FTP | 7 Cat 7A 1200 S/FTP |
|---|---|---|---|---|---|---|---|---|---|
| $F_{max}$ | | MHz | 100 | 155 | 250 | 500 | 600 | 1000 | 1200 |
| $F_{min}$ | | MHz | 4 | 4 | 4 | 4 | 4 | 4 | 4 |
| $v_{max}$ | | / | 0.68 | 0.68 | 0.68 | 0.68 | 0.82 | 0.82 | 0.82 |
| $v_{min}$ | | / | 0.64 | 0.64 | 0.64 | 0.64 | 0.78 | 0.78 | 0.78 |
| RL | LL | m | 0.96 | 0.62 | 0.38 | 0.19 | 0.20 | 0.12 | 0.10 |
| range | UL | m | 25.50 | 25.50 | 25.50 | 25.50 | 30.75 | 30.75 | 30.75 |
| MP | | m | 26 | 26 | 26.0 | 26 | 31.5 | 31.5 | 31.5 |
| RLp $v_{max}$ | | MHz | 3.9 | 3.9 | 3.9 | 3.9 | 3.9 | 3.9 | 3.9 |
| RLp $v_{min}$ | | MHz | 3.7 | 3.7 | 3.7 | 3.7 | 3.7 | 3.7 | 3.7 |

In Table 1, $F_{max}$ is the maximum operating frequency, $F_{min}$ is the minimum operating frequency, $v_{max}$ is the highest velocity factor of four pairs at $F_{max}$, and $v_{min}$ is the lowest velocity factor of four pairs at $F_{min}$.

The lower limit LL and the upper limit UL define a range of periodic occurrences (RL range) in the group helix that could give rise to return loss peaks in the operating frequency range $F_{min}$-$F_{max}$ Hence, the modulation period of the sinusoidal function is chosen above said upper limit (UL) and/or below said lower limit (LL) in order to avoid said RL range.

The lower limit LL is determined by the following formula I as defined previously:

$$LL=v_{min}\cdot 150/F_{max} \quad \text{(I).}$$

The upper limit UL is determined by the following formula II as defined previously:

$$UL=v_{max}\cdot 150/F_{min} \quad \text{(II).}$$

For a return loss peak to occur at a particular frequency, the round trip signal path length from the cable end to the local impedance variation causing the reflection must equal a whole number of wavelengths. If the limit L is in metres, c is the velocity of light in free space in metre/sec (i.e. $3\times10^8$ metre/sec), v is the velocity factor of the twisted pair and F is the signal frequency in MHz then $L=v\cdot3\times10^8/(2\cdot F\cdot10^6)=v\cdot150/F$ .

The smallest and highest velocity factors are chosen according to the requirement for a determined cable application at the maximum operating frequency.

The appended cable specification IEC1156-5 specifies the minimum velocity factor required to ensure compliance with Ethernet rules concerning network diameter and frame collision detection. The minimum velocity factor $v_{min}$ required is 0.60.

The velocity factor, v, of a twisted pair is function of its pitch, the conductor and insulation diameters and the relative permittivity of the insulating material.

The greatest velocity factor $v_{max}$ achievable in data cables such as Cat 7 helically-wound electric cables with blown foam skin insulation (70% polyethylene and 30% gas) is about 0.85.

Concerning data cables such as Cat 5 and Cat 6 helically-wound electric cables with solid polyethylene extruded insulation, the greatest velocity factor $V_{max}$ is about 0.70.

In typical unscreened twisted pair cable, the pairs of twisted conductor wires, more particularly the four pairs of twisted conductor wires, have a range of velocity factors between 0.64 ($v_{min}$) and 0.68 ($v_{max}$).

According to Table 1, the modulation period MP is chosen to be superior to the upper limit UL in order to avoid return loss peaks.

The variable RL peak (RLp) in Table 1 describes the frequency at which return loss peak occurs at the predetermined modulation period MP.

The RL peak (RLp) values, in MHz, are calculated by the following formula:

$$RLp\ v_{max}=(150\cdot v_{max})/MP,$$

$$RLp\ v_{min}=(150\cdot v_{min})/MP,$$

in which MP is in meter.

Hence, the choice of the modulation period MP such as MP inferior to LL or MP superior to UL allows advantageously to avoid retun loss peak in the operating frequency range $F_{min}$-$F_{max}$.

The variations in the pitch of the group helix are illustrated in Table 2 as below, said variations serving to minimize parallelism between the conductor wires, thereby reducing cross-talk.

TABLE 2

| Variable | Unit | 1 Cat 5e U/UTP | 2 Cat 5e U/UTP | 3 Cat 6 U/UTP | 4 Cat 6A F/UTP | 5 Cat 7 600 S/FTP | 6 Cat 7A 1000 S/FTP | 7 Cat 7A 1200 S/FTP |
|---|---|---|---|---|---|---|---|---|
| $L_{ave}$ | mm | 132 | 132 | 110 | 115 | 185 | 83 | 83 |
| $L_{min0}$ | mm | 80 | 80 | 80 | 80 | 80 | 80 | 80 |
| $L_{ampli}$ | mm | 52 | 52 | 30 | 35 | 10 | 3 | 3 |
| $L_{min}$ | mm | 80 | 80 | 80 | 80 | 175 | 80 | 80 |
| $L_{max}$ | mm | 184 | 184 | 140 | 150 | 195 | 86 | 86 |

$L_{ave}$ equates to the fixed cabling pitch (or lay) in prior art cables and about which the sinusoidal variations in cabling pitch (or lay) are to be made in the present invention.

In considering crosstalk peaks, $L_{ave}$ and the pair pitches can advantageously be chosen so as not to interact and cause NEXT peaks in the operating frequency range of the cable. $L_{ave}$ is additionally chosen to be short enough to allow the cable to satisfy the specified minimum bend radius of the cable without distorting the pairs and long enough to achieve the highest possible cabling line speed and hence the lowest manufacturing cost.

Due to the mechanical constraints as mentioned above, the cabling lay lower limit $L_{min}$ is preferably at least 80 mm ($L_{min0}$).

Thus, the permitted cabling lay amplitude $L_{ampti}$ is calculated such as $L_{ampti}=L_{ave}-L_{min}$.

The cabling lay upper limit $L_{max}$ is determined such as: $L_{max}=L_{min}+L_{ampti}$.

A helically-wound electric cable according to the present invention is partially represented in FIG. 1.

This cable comprises four groups P1, P2, P3, and P4 that are wound together so as to form a helix 1 of groups. Each group Pi, where i lies in the range 1 to 4, comprises two twisted-together conductor wires FCi1 and FCi2, and they are therefore referred to as "pairs".

For each pair Pi, the conductor wires FCi1 and FCi2 are wound together helically, but at a pitch L1, L2 that of the helix 1 of groups varies along the helically-wound electric cable in accordance with a sinusoidal function between two limit values having the same sign.

The helically-wound electric cable may also include outer layers (not shown) that protect the helix 1 of groups.

Figure 2:
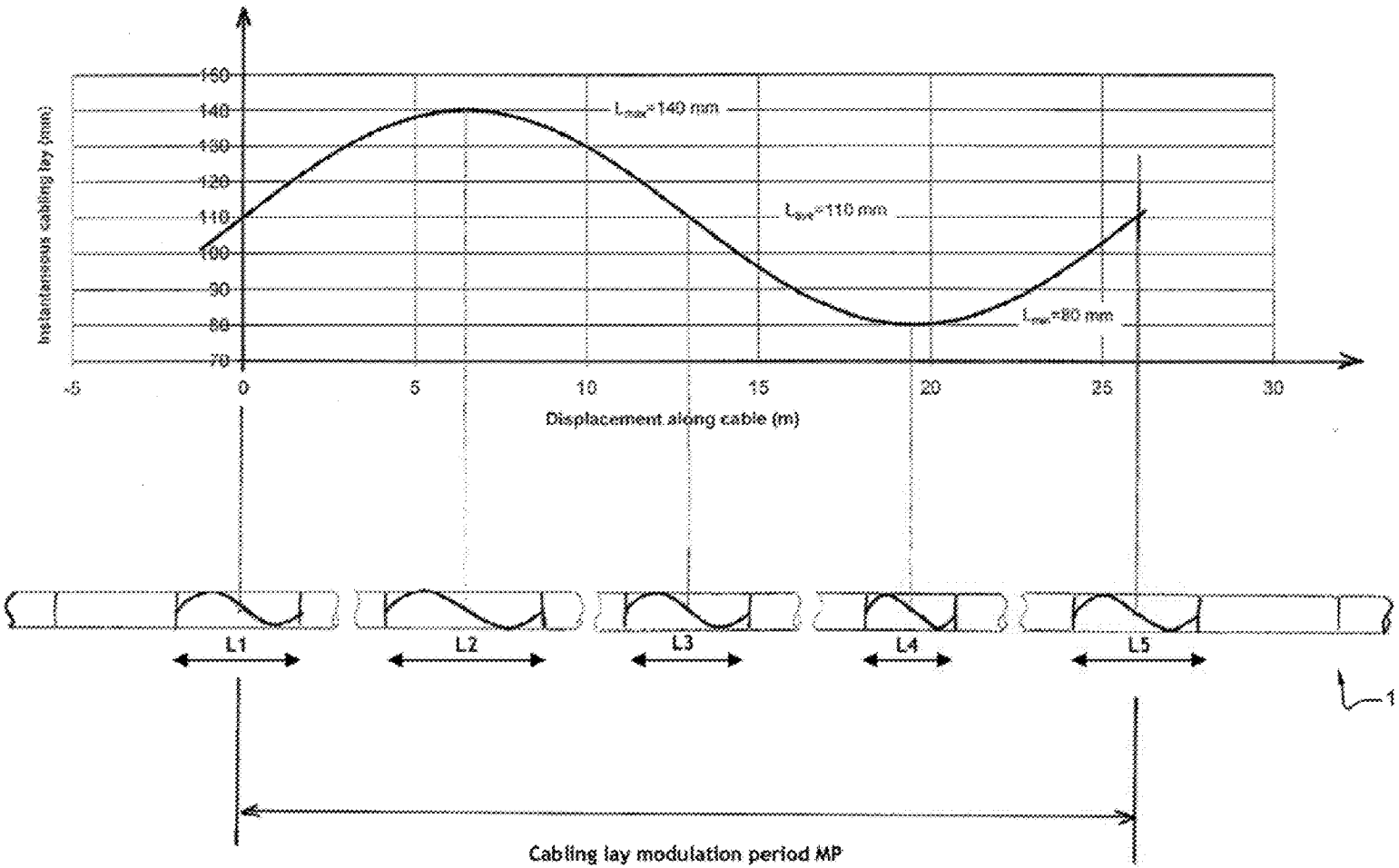
FIG. 2 represents a schematic view of an example of a cabling lay modulation period according to the present invention.

The cabling lay modulation period is not represented in FIG. 1, but is illustrated in FIG. 2 with a schematic view of said helix 1 of groups.

The FIG. 2 represents the helix 1 of groups of the helically-wound electric cable according to the specifications of the reference 3 (Cat 6 U/UTP) as mentioned in Table 1 and in Table 2

The cabling lay modulation period MP, corresponding to an operating frequency range from 4 to 250 MHz and $v_{max}$=0.68, is chosen above the upper limit UL of 25.5 m, such as MP=26.0 m.

For a modulation period of 26.0 m, the return loss peaks for the four pairs occur in the range 3.7 to 3.9 MHz corresponding to $v_{min}$=0.64 and $v_{max}$=0.68 respectively, that is outside the operating frequency range from 4 to 250 MHz ($F_{min}$-$F_{max}$).

According to standard TIA568, the minimum operating frequency $F_{min}$ can be of 1 MHz, instead of 4 MHz for example.

In each modulation period MP, the pitch of the group helix varies along the helically-wound electric cable in accordance with the sinusoidal function between two limit values having the same sign such as between $L_{max}$=140 mm et $L_{min}$=80 mm, from $L_{ave}$=110 mm with an amplitude of 30 mm, as shown in FIG. 2.

Therefore, the lays L1, 12, L3, L4 and L5, as represented in FIG. 2, are respectively of 110 mm, 140 mm, 110 mm, 80 mm and 110 mm.

Said variations between the limits $L_{min}$ and $L_{max}$ prevent advantageously the appearances of NEXT peaks.

Figure 3:
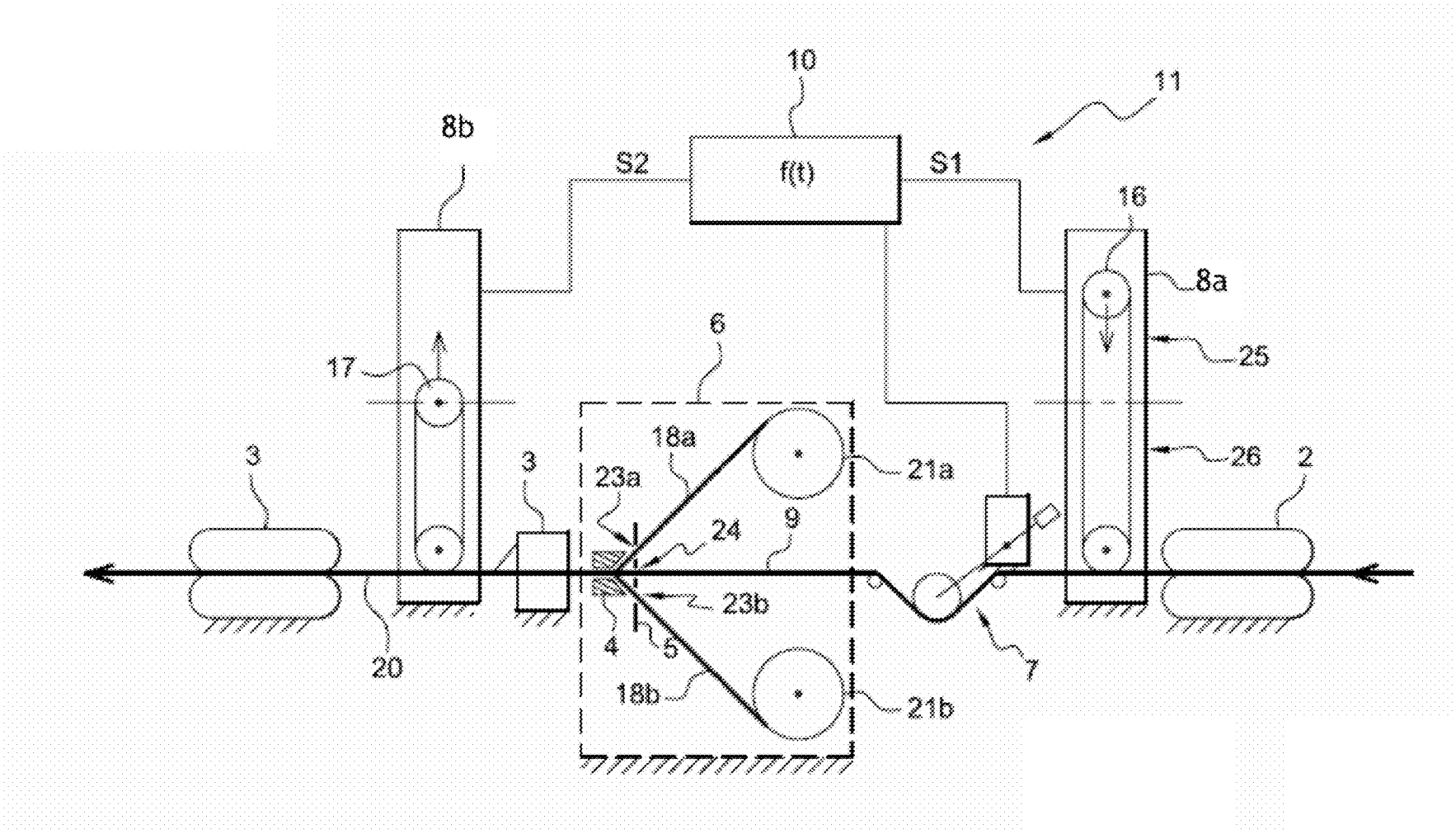
FIG. 3 shows an example of manufacturing apparatus according to the present invention.

The FIG. 3 shows an example of apparatus for manufacturing such a cable. The manufacturing apparatus 11 comprises winder means 6 for winding two groups 18*a*, 18*b* about a central line 9. The central line 9 is subjected to movement in translation between inlet caterpillars 2 and outlet caterpillars 3.

Each group 18*a*, 18*b* comprises a plurality of twisted-together conductor wires, e.g. copper wires.

In this example, the winder means six carry reels 21*a*, 21*b*. Each reel 21*a*, 21*b* serves to carry a supply of one of the groups 18*a*, 18*b*. Rotary drive means (not shown) cause the reels 21*a*, 21*b* to be rotated about the central line 9. The two groups 18*a*, 18*b* are thus wound so as to form a group helix 20.

The winder means 6 also comprise a distribution plate 5 having two peripheral openings 23*a*, 23*b* and a central opening 24. Each peripheral opening 23*a*, 23*b* receives a respective one of the groups 21*a*, 21*b*. The central opening 24 receives the central line 9. The winder means may also comprise a die 4 at the outlet from the distribution plate 5.

At the outlet from the die 4, binder applicator means 3 serve to apply a binder so as to fix the wound groups in position.

The groups 18*a*, 18*b* are wound about the central line 9 at a rotational speed that is substantially constant, e.g. 50 revolutions per minute (rpm). In contrast, the linear speed of the central line 9 varies over time, at least in the winder means 6, such that the group helix 20 presents a pitch that varies along the helically-wound electric cable manufactured in this way.

The linear speed of the central line 9 is substantially constant over time upstream from the manufacturing apparatus 11, and also downstream from the manufacturing apparatus 11, e.g. being equal to 0.1 meters per second (m/s). The linear speed of the central line 9 varies on going through the winder means 6.

By way of example, if the rotational speed (RS) of the reels 21*a*, 21*b* is 50 rpm and the average cabling lay $L_{ave}$ is 110 mm, then the upstream and downstream central line speed is (50×0.110/60)=0.092 meter per second (m/s).

The manufacturing apparatus 11 includes means for varying the pitch of the group helix, said means comprising two accumulators 8*a*, 8*b* disposed respectively upstream and downstream from the winder means 6. Each accumulator 8*a*, 8*b* comprises a moving drum 16, 17 enabling a varying length of the central line 9 to be retained. The linear speed of the central line 9 varies whenever the position of one or the other of the moving drums 16, 17 varies.

The manufacturing apparatus 11 also comprises control means 10 for controlling the position of each of the moving drums 16, 17. The control means 10 are connected to the accumulators 8*a*, 8*b*. The position of each moving drum 16, 17 is a function of the voltage amplitude of a corresponding control signal S1, S2, with the control signals S1, S2 being generated by the control means 10.

The control means 10 produce sine wave control voltages S1 and S2 in antiphase so as to cause the necessary vertical contrary motion of the accumulators drums 16 and 17.

In other words, the first and second control signal S1 and S2 are generated in such a manner that at all times their values are opposite. The positions of the first and second moving drums 16 and 17 relative to a mid-line at mid-height in each of the accumulators 8*a*, 8*b* are thus opposite.

Hence, the pitch of the group helix 20 varying in application of a sinusoidal function, the control signals S1, S2 likewise vary sinusoidally.

When the moving drums 16, 17 move, the linear speed of the central line 9 through the winder means 6 varies.

Thus, the linear speed of the central line 9 through the winder means 6 is thus likewise substantially equal to the linear speed of the central line upstream from the manufacturing apparatus 11 incremented by a variation term. The variation term is substantially proportional to the first derivative of the first control signal. The variation term can thus be instantaneously positive, negative, or zero over time.

The control signals S1, S2 allows that the group helix 20 is confined between two limit values having the same sign in accordance with a sinusoidal function having a determined modulation period.

For example, the linear speed of the central line 9 may vary over the range about 0.075 m/s to 0.12 m/s.

With such limit linear speeds, and with a rotational speed of about 100 rpm, the helical pitch of the groups varies over the range about 0.08 m ($L_{min}$) to about 0.15 m ($L_{max}$), with a $L_{ave}$ of 0.115 m.

The table 3 below gives the linear speeds in the central line 9, between the accumulators 8*a* and 8*b* for the cable having the cabling lay range shown in FIG. 2 when cabled with a rotational speed of 50 or 100 rpm.

TABLE 3

| | | Linear speed (meter/sec) | |
|---|---|---|---|
| Cabling lay (meter) | | at a rotational speed of 50 rpm | at a rotational speed of 100 rpm |
| $L_{max}$ | 0.140 | 0.116 | 0.233 |
| $L_{ave}$ | 0.110 | 0.092 | 0.183 |
| $L_{min}$ | 0.080 | 0.067 | 0.133 |

In the example tabulated above with an average cabling lay of 0.110 m, the modulation period MP of 26 m is generated by said sinusoidal function with a modulation time MT of 2.36 or 4.73 min in the case of a rotational speed of 100 or 50 rpm, respectively.

The modulation time MT, in minutes, which should be input in the control means 10, is equal to MP/($L_{ave}$×RS), where MP and $L_{ave}$ are in meters, and RP (Rotational Speed) in rpm.

The manufacturing apparatus 11 may also include means 7 for measuring the stiffness of the central line 9. The stiffness measurement means 7 are connected to the control means 10 and thus enable the control signals to be adjusted so that the linear speed of the central line at the inlet to the winder means 6 is substantially equal to the linear speed of the central line at the outlet from the winder means 6.

The invention claimed is:

1. A helically-wound electric cable comprising:

at least two groups wound together so as to form a group helix, each group having at least two twisted-together conductor wires, the pitch of the group helix varying along the helically-wound electric cable in accordance with a sinusoidal function between two limit values having the same sign, wherein said sinusoidal function has a determined modulation period (MP) in order to avoid return loss peak (RLp) in the operating frequency range ($F_{min}$-$F_{max}$) of said helically-wound electric cable.

2. The helically-wound electric cable according to claim 1, wherein the modulation period (MP) is below a lower limit LL, in meter, of the following formula:

$$LL=v_{min}\cdot 150/F_{max} \quad \text{(I)}$$

in which $F_{max}$, in MHz, is the maximum operating frequency of the helically wound electric cable and $v_{min}$ is the smallest velocity factor required for a determined cable application at the maximum operating frequency $F_{max}$.

3. The helically-wound electric cable according to claim 1, wherein the modulation period (MP) is above an upper limit UL, in meter, of the following formula:

$$UL=v_{max}\cdot 150/F_{min} \quad \text{(II)}$$

in which $F_{min}$, in MHz, is the maximum operating frequency of the helically wound electric cable and $v_{max}$ is the highest velocity factor required for a determined cable application at the minimum operating frequency $F_{min}$.

4. The helically-wound electric cable to claim 1, wherein said twisted conductor wires directly abut one another.

5. The helically-wound electrical cable to claim 1, wherein said cable further comprises at least one additional group helix.

* * * * *